US007237627B2

(12) United States Patent
Richman et al.

(10) Patent No.: US 7,237,627 B2
(45) Date of Patent: Jul. 3, 2007

(54) BEARING AND LUBRICATION SYSTEM FOR EARTH BORING BIT

(75) Inventors: Lance T. Richman, Ponca City, OK (US); Chris Edward Cawthorne, The Woodlands, TX (US); Kirk A. Norris, Sand Springs, OK (US); Robert H. Slaughter, Jr., Ponca City, OK (US)

(73) Assignee: Smith International, Inc., Houston, TX (US)

( * ) Notice: Subject to any disclaimer, the term of this patent is extended or adjusted under 35 U.S.C. 154(b) by 250 days.

(21) Appl. No.: 10/948,664

(22) Filed: Sep. 23, 2004

(65) Prior Publication Data

US 2005/0077087 A1 Apr. 14, 2005

Related U.S. Application Data

(60) Provisional application No. 60/505,725, filed on Sep. 24, 2003.

(51) Int. Cl.
*E21B 10/00* (2006.01)
*E21B 10/24* (2006.01)

(52) U.S. Cl. ..... 175/372; 175/228; 175/337; 384/92; 384/94; 384/95

(58) Field of Classification Search ..... 175/57, 175/228, 337; 384/94, 95, 276, 474, 475
See application file for complete search history.

(56) References Cited

U.S. PATENT DOCUMENTS

| | | | | |
|---|---|---|---|---|
| 3,971,600 | A | 7/1976 | Murdoch et al. | |
| 4,199,856 | A * | 4/1980 | Farrow et al. | 29/454 |
| 4,280,571 | A * | 7/1981 | Fuller | 175/337 |
| 6,220,374 | B1 * | 4/2001 | Crawford | 175/372 |
| 6,869,223 | B2 * | 3/2005 | Azumi et al. | 384/466 |

* cited by examiner

*Primary Examiner*—David Bagnell
*Assistant Examiner*—Brad Harcourt
(74) *Attorney, Agent, or Firm*—Conley Rose, P.C.

(57) ABSTRACT

Methods and apparatus for maintaining lubrication of rolling cone cutters mounted on journal pins. Embodiments comprise a rotating cone disposed on a journal pin and forming a journal gap there between. A cylindrical journal sleeve is disposed in the journal gap. The journal sleeve has a longitudinal gap forming opposing end portions, which are continuously contoured. A lubrication port is disposed in the journal pin and in fluid communication with a lubrication supply. The lubrication port has an outlet located in a recess in the journal gap. Each end of the recess comprises a transitioning surface extending between the bottom of the recess and the outer surface of the journal pin to prevent sharp transitions. In certain embodiments, the journal pin may comprise two or more lubrication ports, each located in a recess with transitioning surfaces.

20 Claims, 6 Drawing Sheets

BEARING AND LUBRICATION SYSTEM FOR EARTH BORING BIT

CROSS-REFERENCE TO RELATED APPLICATIONS

The present application claims priority to U.S. Provisional Application No. 60/505,725, filed Sep. 24, 2003, titled "Bearing and Lubrication System for Earth Boring Bit," and hereby incorporated herein by reference for all purposes.

STATEMENT REGARDING FEDERALLY SPONSORED RESEARCH OR DEVELOPMENT

Not Applicable

BACKGROUND OF THE INVENTION

1. Field of the Invention

The invention relates generally to earth-boring bits. More particularly, the invention relates to maintaining lubrication of rolling cone cutters that are mounted on journal pins. Still more particularly, the invention relates to apparatus for maintaining an appropriate thickness of lubrication between opposing surfaces that rotate relative to one another so as to extend bearing and bit life.

2. Description of the Related Art

An earth-boring drill bit is mounted on the lower end of a drill string and is rotated by revolving the drill string. With weight applied to the drill string, the rotating drill bit engages the earthen formation and proceeds to form a borehole along a predetermined path toward a target zone. An earth-boring bit comprises one or more rotatable cone cutters that perform their cutting function due to the rolling movement of the cone cutters acting against the formation material. The cone cutters roll and slide upon the bottom of the borehole as the drillstring and bit are rotated, the cone cutters thereby engaging and disintegrating the formation material in their path. The rotatable cone cutters may be described as generally conical in shape and are therefore referred to as rolling cones.

Rolling cone bits comprise a bit body with a plurality of journal segment legs. The cones are mounted on bearing pin shafts (also called journal shafts or journal pins) that extend downwardly and inwardly from the journal segment legs. As the bit is rotated, cutter elements or teeth that extend from the cone cutters remove chips of formation material ("cuttings" or "drilled solids") which are carried upward and out of the borehole by the flow of drilling fluid which is pumped downwardly through the drill pipe and out of the bit.

The cost of drilling a borehole is proportional to the length of time it takes to drill to the desired depth and location which, in turn, is greatly affected by the number of times the drill bit must be changed in order to reach the targeted formation. This is the case because each time the bit is changed, the entire string of drill pipes—which in oil and gas well drilling may be miles long—must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. The amount of time required to make a round trip for replacing a bit is essentially lost time and lost productivity from drilling operations. It is therefore advantageous to employ drill bits that will be durable enough to drill for a substantial period of time with acceptable rates of penetration (ROP) so as to minimize the number of "trips" and the associated lost productivity.

One cause of bit failure arises from the severe wear or damage that may occur to the bearings on which the cone cutters are mounted. These bearings can be friction bearings (also referred to as journal bearings) or roller type bearings, and are subjected to high drilling loads, high hydrostatic pressures, and high temperatures. Conventional rolling cone bits comprise lubricant systems within their journal segments for communicating lubricant from a reservoir in the bit to the narrow space—or journal gap—which exists between the journal pin and cone cutter. Seals are provided in the journal gap to prevent lubricant from escaping from around the bearing surfaces and also to prevent the cutting-laden, abrasive drilling fluid that is present in the borehole from entering the gap. Maintaining adequate lubrication of the bearings is thus critical to maintaining the life of the cone cutter assembly and of the bit. Consequently, the frequency with which the bit must otherwise be replaced due to bit failure or loss of an acceptable ROP may be reduced by maintaining proper lubrication of the cone cutters.

Thus, the embodiments of the present invention are directed toward methods and apparatus for maintaining lubrication of rolling cone cutters that are mounted on journal pins that seek to overcome certain limitations of the prior art.

SUMMARY

Embodiments of the invention comprise methods and apparatus for maintaining lubrication of rolling cone cutters mounted on journal pins. The embodiments comprise a rotating cone disposed on a journal pin and forming a journal gap there between. A cylindrical journal sleeve is disposed in the journal gap. The journal sleeve has a longitudinal gap forming opposing end portions, which are continuously contoured. A lubrication port is disposed in the journal pin and in fluid communication with a lubrication supply. The lubrication port has an outlet located in a recess in the journal gap. Each end of the recess comprises a transitioning surface between the bottom of the recess and the outer surface of the journal pin. In certain embodiments, the journal pin may comprise one or more lubrication ports, each located in a recess with transitioning surfaces.

In one embodiment, a drill bit comprises a journal pin and a roller cone disposed on the journal pin. A journal gap if formed between the journal pin and the roller cone. A journal sleeve, comprising continuously contoured opposing end portions forming a longitudinal gap, is disposed in the journal gap. A lubrication port is disposed in the journal pin and is in fluid communication with both a lubrication supply and the journal gap. A recess surrounds an outlet from the lubrication port and comprises transition surfaces between the recess and the outer surface of the journal pin. The continuously contoured opposing end portions comprise an end surface intersecting an inner surface and an outer surface, wherein the surface intersections have radiuses greater than 0.020 inches. The intersections between the transition surfaces of the recess and the outer surface of the journal pin are radiused, as is the intersections between the transition surfaces and the bottom surface of the recess.

In another embodiment, a lubrication system, for a drill bit comprising a roller cone disposed on a journal pin, comprises a journal gap, disposed between the roller cone and the journal pin, and a cylindrical journal sleeve disposed within the journal gap and comprising a longitudinal slot forming opposing end portions. Each end portion is continuously contoured. A lubrication port is disposed within the journal pin and provides fluid communication between a lubrication supply and an outlet disposed in the journal gap. A recess is disposed on the journal pin and surrounds the outlet from said lubrication port. The recess comprises transition surfaces between the recess and the journal pin.

In another embodiment, a method, for lubricating a drill bit comprising a roller cone rotating about a journal pin, comprises providing a journal gap disposed between the roller cone and the journal pin and providing a journal sleeve disposed within the journal gap. The journal sleeve has a longitudinal slot forming opposing ends, which are shaped such that they are continuously contoured. A lubricant is provided from a lubricant supply into a lubrication port disposed in the journal pin. An outlet in communication with the lubrication port is provided within a recess on the outer surface of the journal pin, wherein the recess comprises transition surfaces between the recess and the outer surface of the journal pin.

Thus, the present invention comprises a combination of features and advantages that enable it to provide lubrication for a roller cone drill bit. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION

Figure 1:
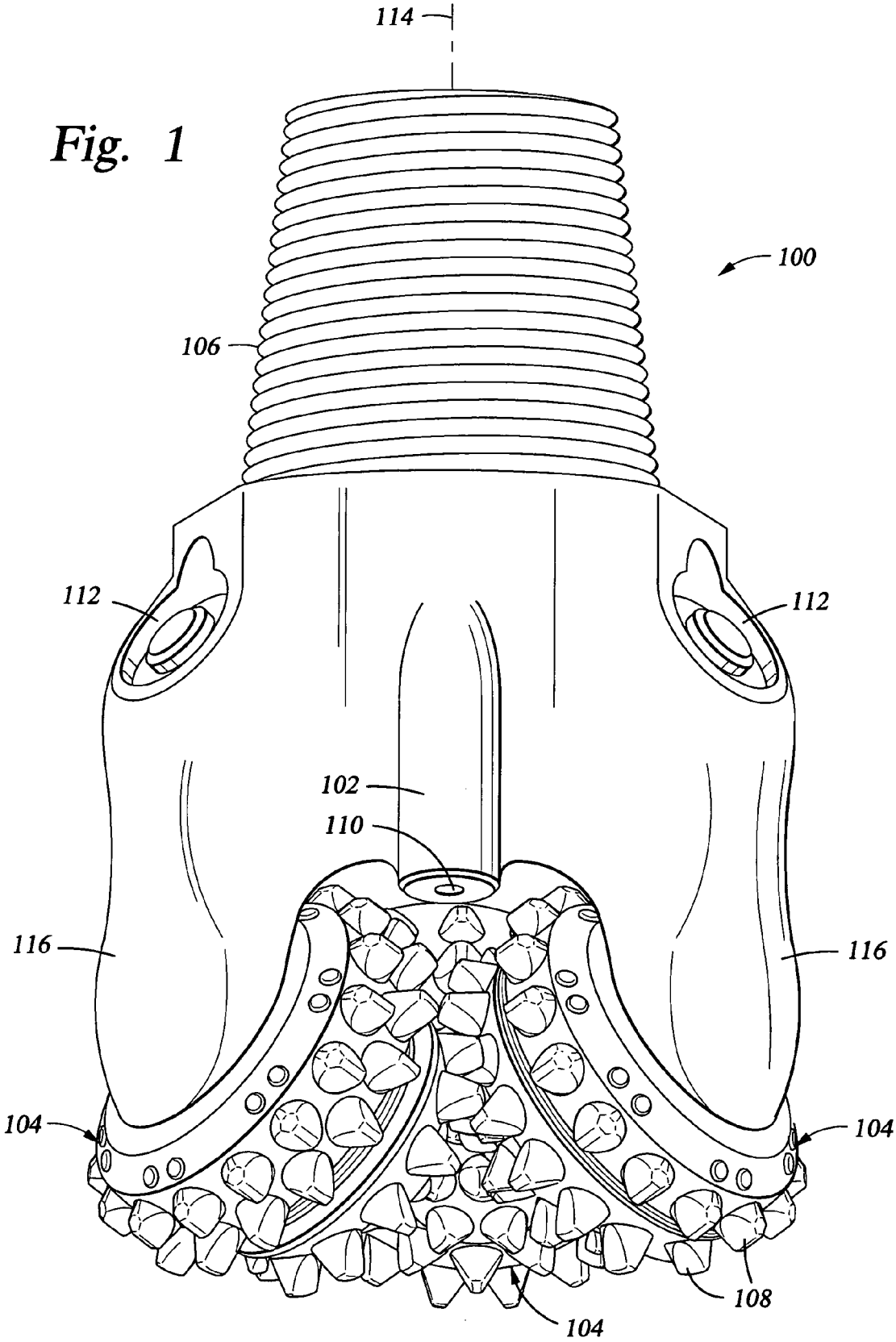
FIG. 1 is a perspective view of an earth-boring bit.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In particular, various embodiments described herein thus comprise a combination of features and advantages that overcome some of the deficiencies or shortcomings of prior art seal assemblies and drill bits. The various characteristics mentioned above, as well as other features and characteristics described in more detail below, will be readily apparent to those skilled in the art upon reading the following detailed description of preferred embodiments, and by referring to the accompanying drawings.

Embodiments of the present invention comprise a bearing and lubrication system for earth boring bits, and features aimed at improving lubricant distribution in the journal gap of such bits. FIG. 1 illustrates a rotary cone drill bit 100 comprising a body 102, and three legs 116, each supporting a rolling cutter cone 104 mounted on its lower end. Bit 100 further comprises a threaded pin 106 at the upper end of the body for assembly of the rock bit onto a drill string (not shown). Each cone cutter 104 is rotatably mounted on a journal pin (not shown in FIG. 1). A plurality of cutter elements, such as tungsten carbide inserts 108, are pressed into holes in the surfaces of the cutter cones 104 for bearing on the rock formation being drilled. Nozzles 110 in the bit body introduce drilling fluid into the space around the cutter cones 104 for bit cooling and for carrying away formation chips drilled by the bit. A grease reservoir, described in greater detail below, is generally disposed in grease reservoir cavity 112 disposed in each leg 116.

Figure 2:
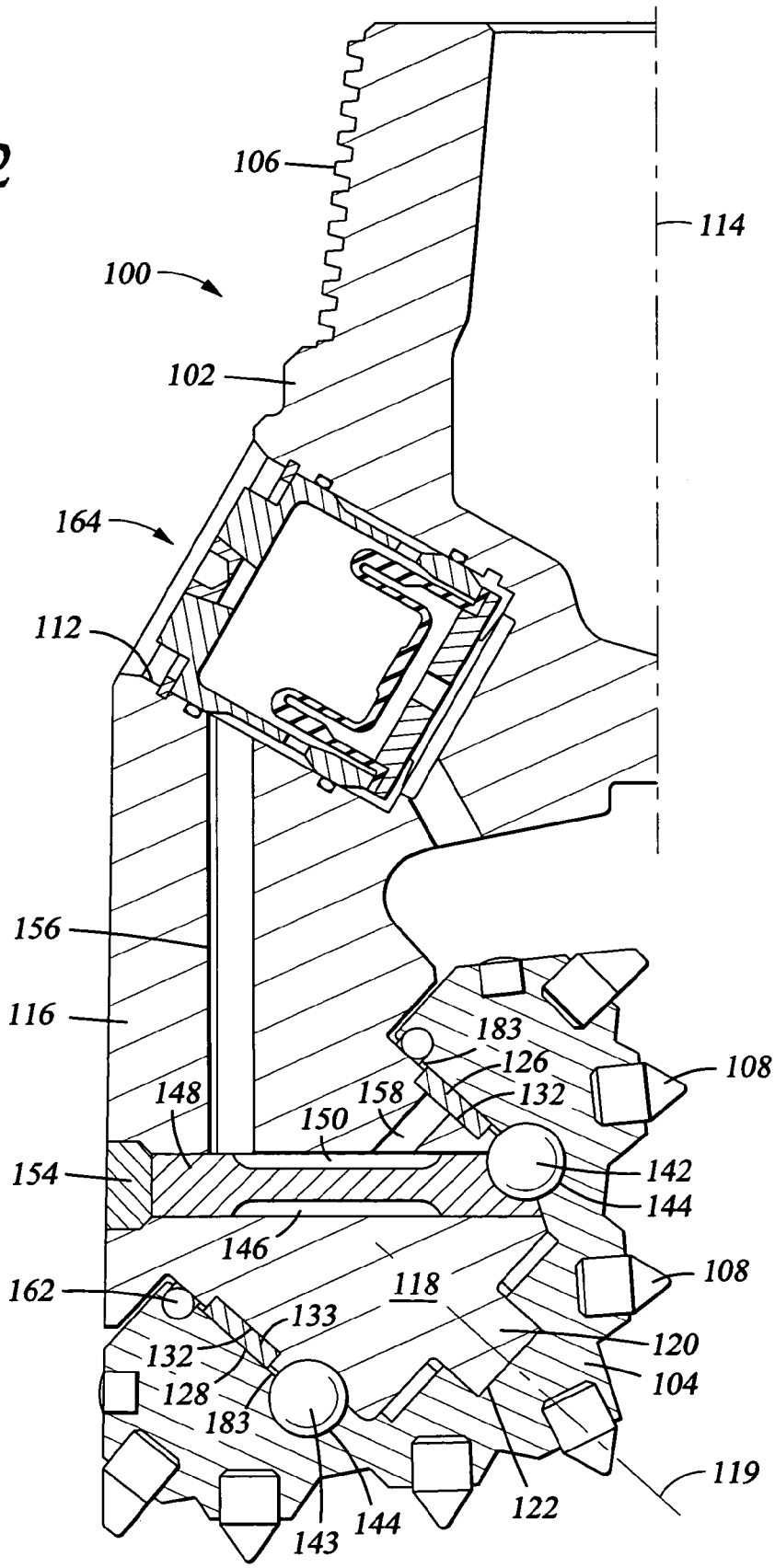
FIG. 2 is a partial cross-sectional view through one of the legs of the bit of FIG. 1.

FIG. 2 is a fragmentary, longitudinal cross-section of the chill bit 100 shown in FIG. 1, the cross-section extending radially from the rotational axis 114 of the bit though one of the three legs 116 and one cutter cone 104. Each leg 116 comprises a journal pin 118 extending downwardly and radially, inwardly from the bit body 102. Leg 116 further comprises grease reservoir subassembly 164 and grease passage-way 156.

Journal pin 118, comprising longitudinal axis 119, comprises a generally cylindrical bearing surface 133, and a cylindrical nose, or spindle portion 120, of reduced diameter at the lower end 122 of pin 118. Pin 118 further comprises an annular groove or ball race 143 between bearing surface 133 and spindle portion 120.

Each cutter cone 104 is in the form of a generally conical body comprising a central bore or cavity 126 for receiving journal pin 118. Cemented tungsten carbide inserts 108 are pressed into holes on the external surface. For long life, the inserts 108 may be tipped with a polycrystalline diamond layer. Such tungsten carbide inserts 108 enhance formation removal by engaging the subterranean formation as the bit 100 is rotated. Some bits have teeth milled on the outer surface of the cone 104 rather than employing inserts as cutting elements. Such bits are referred to as "milled-tooth" or "steel tooth" bits.

The cavity 126 in the cone 104 comprises a generally cylindrical bearing surface 128 concentric to pin bearing surface 133. Cavity 126, of cone cutter 104, further comprises annular groove forming a ball race 144. Disposed about the bearing surface 133 of the pin 118 is a floating journal sleeve 132. Collectively, sleeve 132 and journal bearing surfaces 133 and 128 provide the main bearing surfaces for the cone 104 on the bit leg 116.

Upon assembly of the cone 104 on journal pin 118, plurality of locking balls 142 are fitted into complementary ball races 143, 144. Balls 142 are inserted through a ball passage 146, which extends through the journal pin between the ball races 143, 144 and the exterior of the rock bit leg 116. The balls 142 carry any thrust loads tending to dislodge the cone 104 from the journal pin 118, and thereby serve to retain the cone on the journal pin. The balls 142 are retained in the races 143, 144 by a ball retainer 148 that is inserted through the ball passage 146 after the balls are in place in the ball races. The ball retainer 148 may be of such diameter as to not completely fill the ball passage 146, allowing a portion of the ball passage diameter to serve as a grease passage 150 for communicating lubricant to the ball races 143, 144 and journal bearing surfaces 128, 133.

Grease passage 150 interconnects and is in fluid communication with leg grease passageway 156. A plug 154 is welded or otherwise secured into the end of the ball passage 146 to keep the ball retainer 148 in place. Although shown as the same passage, it will be understood that an alternative embodiment may comprise a grease passage 150 distinct from ball passage 146, while still maintaining fluid communication with leg grease passage 156 and ball races 143, 144. Additionally, journal pin 118 comprises additional grease passageways 158 (one shown in FIG. 2) for communicating lubricant to bearing surface 133, and in particular, to the area between surface 133 and the inner surface 180 of journal sleeve 132 (FIG. 5) as described in more detail below.

Grease, or another lubricant, lubricates the bearing surfaces 128, 133 between the journal pin 118 and the cone 104. Preferably, upon assembly of the bit 100, the interior of the bit is evacuated, and lubricant is introduced through a fill passage (not shown). The lubricant thus fills the regions adjacent the bearing surfaces 128, 133 plus passages 158, 150 and 156 and grease reservoir subassembly 164, air being essentially excluded from the interior of the bit 100. When the rock bit is assembled, the ball races 143, 144, the journal gap 160, the leg grease passages 156, 158 and 150 are all filled with lubricant. If desired, a pressure-relief check valve (not shown) can also be provided in the reservoir subassembly 164 for relieving over-pressures in the lubricant system that could damage the seal ring 162.

The reservoir subassembly 164 is disposed in a cavity 112 in the bit body 102. Leg grease passageway 156 is disposed between reservoir 164 and ball passage 146. Lubricant also fills the portion of the ball passage 146 adjacent the ball retainer 148 and journal gap 160. The journal gap 160 (best shown in FIG. 3) may be defined as the narrow space between bearing surfaces 128 and 133. Journal sleeve 132 is disposed about pin 118 and in journal gap 160. Lubricant is retained in the journal gap 160 by a resilient seal in the form of a seal ring 162 or other seal assembly disposed between the cone 104 and journal pin 118, or between cone 104 and bit leg 116.

Although a rotary cone drill bit comprising a reservoir subassembly 164 with a pressure compensation subassembly is shown, it will be understood that some rotary cone drill bits are configured without pressure compensation subassemblies. For example, rotary cone drill bits used in mining operations, i.e., mining bits, are used in operating conditions different from that of bits where pressure compensation is not necessary.

Figure 3:
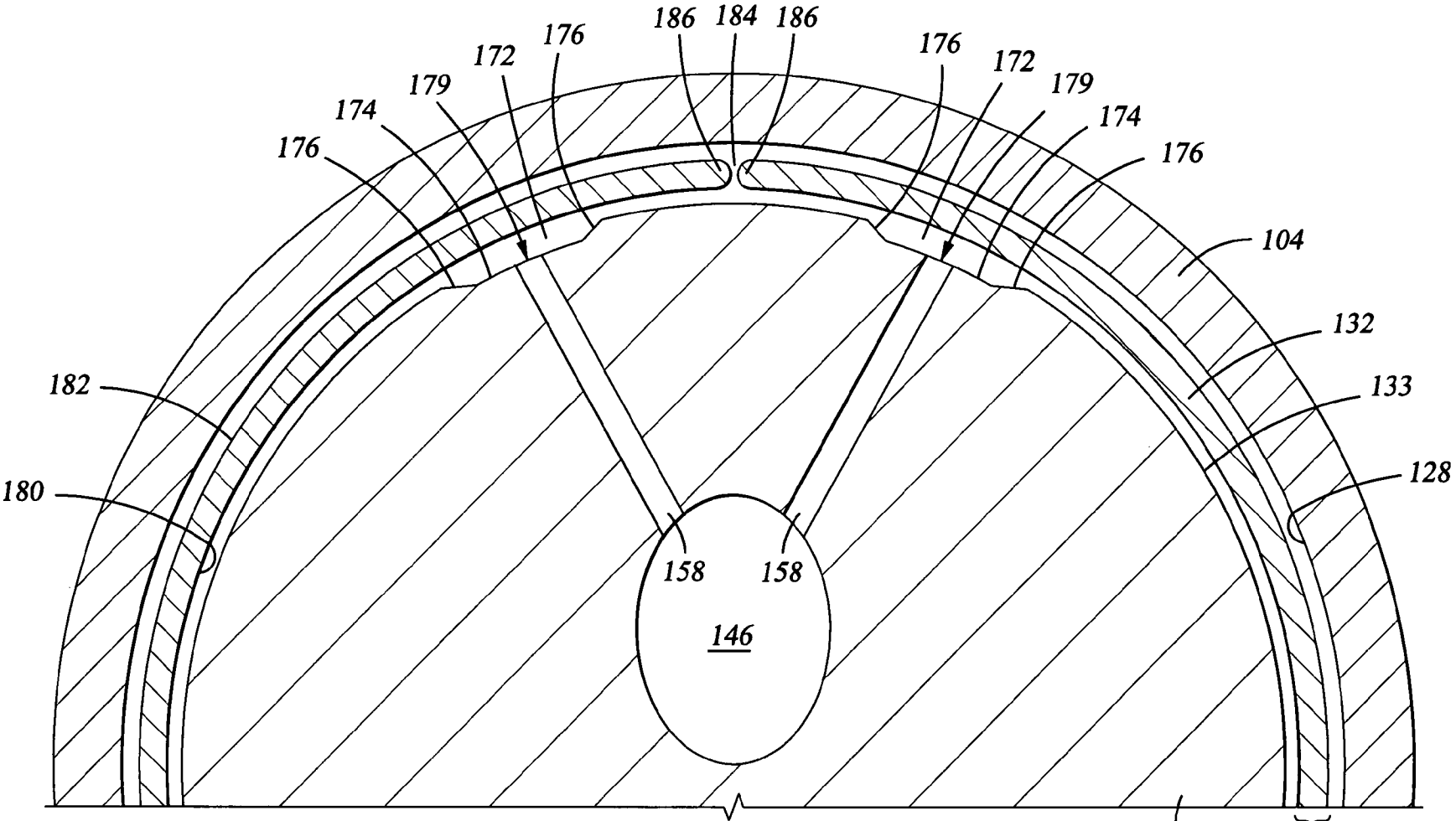
FIG. 3 is a partial cross-sectional view through a journal pin of the bit of FIG. 1.

FIG. 3 is a partial cross-sectional view of one leg 116 of bit 100. The section is taken perpendicular to longitudinal axis 119 of journal pin 118. The portion shown in FIG. 3 is the "unloaded" side, or the side of journal pin 118 located away from the portion of cone 104 that contacts the formation. In general, all mining bits have pressure compensation systems to handle the internal grease expansion pressure.

Formed in bearing surface 133 of journal pin 118 are a pair of recesses 172. Recesses 172 comprise bottom surfaces 174 and a transitioning surface 176 at each end of recess 172, transitioning surfaces 176 extending between bottom surface 174 and bearing surface 133. Recesses 172 are formed on the segment of bearing surface 133 that is closest to pin end 106 of bit 100. In this position, recesses 172 may be described as being disposed on the unloaded side of journal pin 118. Recesses 172 are formed on journal pin 118 so as to be generally centered about the terminus of grease passageways 158. Each grease passage 158 is in fluid communication with grease passageway 146. Grease, or another lubricant, in grease passage 158 (from FIG. 2) communicates with recess 172 such that recess 172 may generally be described as a grease port 179.

Journal sleeve 132 is disposed between cone 104 and journal pin 118, in gap 160. Sleeve 132 is shown to comprise inner surface 180 and outer surface 182. Sleeve 132 is a generally cylindrical body that also comprises edge surfaces 183, which can be seen in FIG. 2. A split, or gap 184 is formed in sleeve 132 such that the sleeve comprises opposing end portions 186, which are further discussed below.

As mentioned above, recesses 172 are disposed on the unloaded side of journal pin 118. Although other circumferential lengths of recesses 172 may be employed, in this embodiment, each recess 172 comprises an arcuate length of approximately 20 to 40 degrees as measured between ends 178 of recesses 172 relative to pin axis 119. In this embodiment, bottom surface 174 between transition sections 176 is generally an arcuate surface of generally constant radius. Recesses 172 are generally also a constant depth as measured along bottom surface 174 between surface 174 and 133, such depth being approximately 0.5% to 5% of D, where D is the diameter of cylindrical bearing surface 133.

Figure 4:
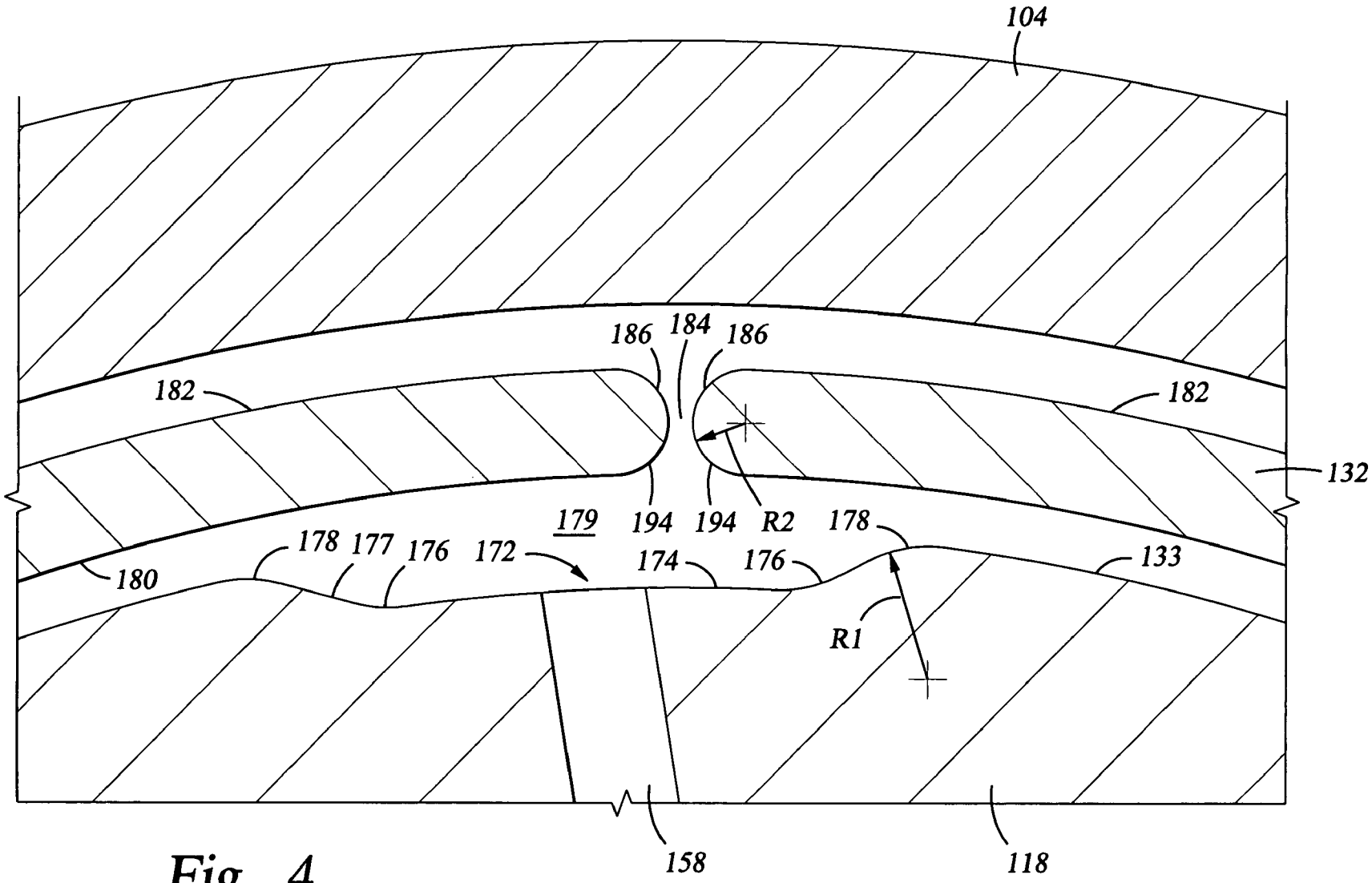
FIG. 4 is an enlarged view of a portion of the cross-section of FIG. 3.

Referring now to FIG. 4, a close-up view of journal pin 118, journal sleeve 132, and roller cone 104 is shown. As best shown in FIG. 4, transition segments 176 extend between bottom surface 174 and bearing surface 133. The outer or terminal ends 178 of transition segments 176 form terminal surfaces 177 comprising an internal radius R1. Terminal surfaces intersect surface 133 at end 178. Although R1 can vary substantially, it is important that there be a smooth transition at end 178 between transition surface 176 and bearing surface 133 so as to avoid relatively sharp intersections that might tend to scrape and remove lubricant from journal sleeve 132 as described in more detail below. In the embodiment shown in FIG. 4, R1 is substantially equal to 2.5 percent of the radius defining cylindrical bearing surface 133.

Opposing ends 186 of journal sleeve 132 are preferably "continuously contoured" between inner surface 180 and outer surface 182. As used herein, the term "continuously contoured" refers to surfaces that can be described as continuously curved surfaces wherein the surface is free of relatively small radii (less than 0.020 inches) that have conventionally been used to break sharp edges or round-off transitions between adjacent distinct surfaces. Eliminating sharp breaks or abrupt changes in curvature between adjacent regions on the surface lessens the likelihood of the intersection acting as a wiper or scraper that would tend to remove grease from a surface and thereby contribute to, or cause, premature bearing or bit failure. Similarly, providing a continuously contoured surface between inner surface 180 and outer surface 182 enhances the ability of the lubrication system to provide a lubricant film of consistent depth between journal sleeve 132 and bearing surface 133. Several embodiments of the continuously contoured ends 186 of journal sleeve 132 are described in reference to FIGS. 6A–6D below.

Referring still to FIG. 4, journal sleeve 132 is shown disposed about journal pin 118 and positioned such that end portions 186 are generally adjacent grease port 179. It is to be understood, of course, that floating journal sleeve 132 may rotate about pin 118 such that, at other instances of time, end portions 186 will be located at other angular positions relative to grease port 179. As bit 100 rotates along the borehole bottom, journal sleeve 132 will rotate about pin 118. As this occurs, grease in port 179 may flow between journal sleeve 132 and outer cylindrical surface 133 of pin 118. The absence of sharp edges or abrupt changes at surface intersections at end portions 186 and, particularly due to the internal radii on inner transition surface 194 insures that a film of lubricant is disposed between sleeve 132 and cylindrical surface 133 and that the thickness of the film is generally uniform.

Lubrication port 179, formed with transition surfaces 176 described above, minimizes the pressure changes in the lubricant as it moves across port 179. Some of the lubricant will travel with sleeve 132 as it rotates about pin 118. As a selected point on sleeve 132 is rotated toward lubrication port 179, the volume of space between the journal pin 118 and the rotating sleeve 132 gradually increases, thus creating a void that decreases the pressure within the lubricant. As the selected point continues to move over the mid point of the communication port 179, the volume of space between the rotating members begins to reduce, and the pressure within the lubricant increases. This increased pressure forces the lubricant to spread evenly between the bearing surfaces 180 and 133 of the rotating members and acts to provide an even distribution of lubricant between sleeve 132 and bearing surface 133 of the journal pin.

Figure 5:
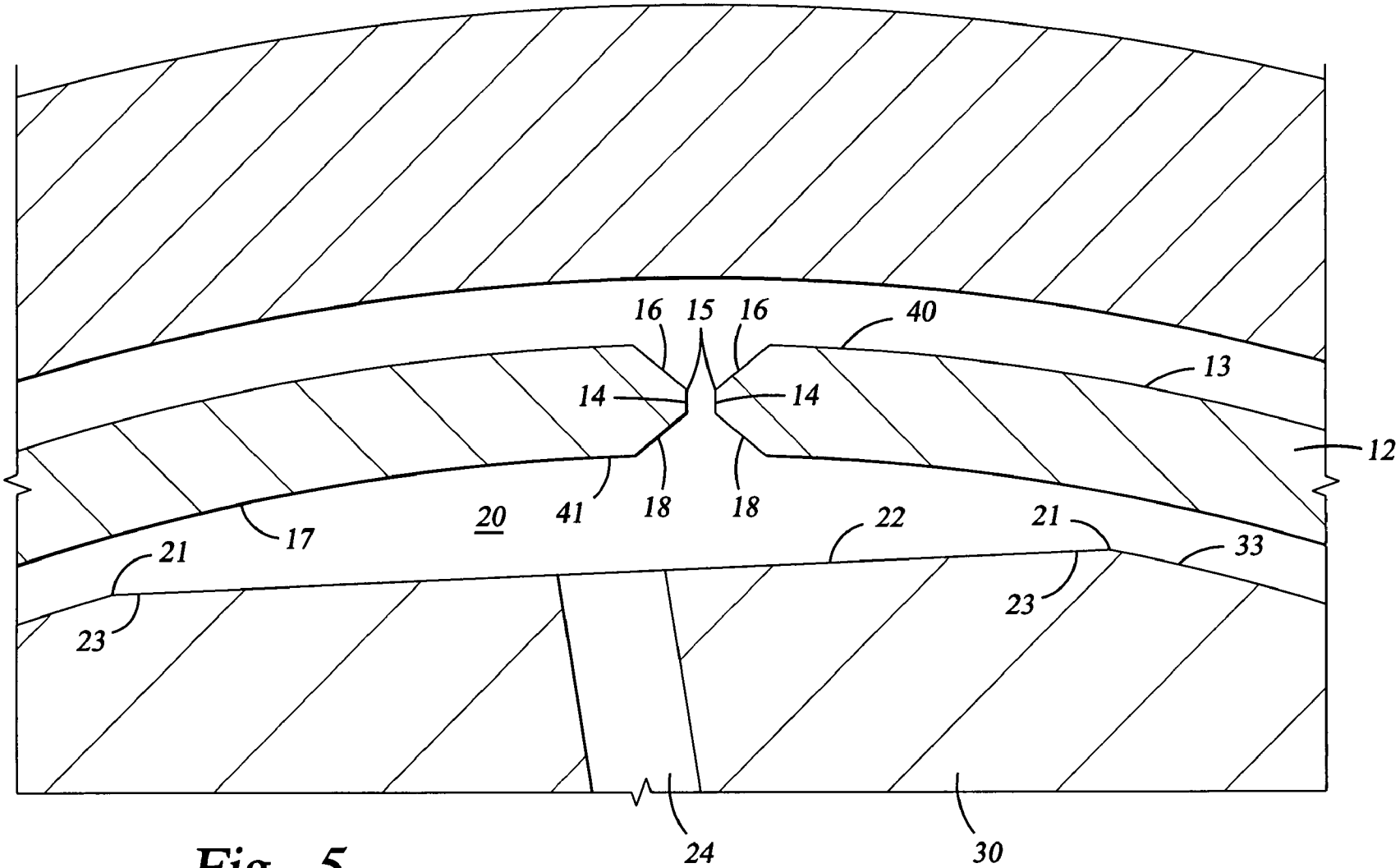
Fig. 5 (PRIOR ART)
FIG. 5 is an enlarged, cross-sectional of a journal pin and lubrication system of a prior art bit.

The arrangement of FIG. 4 can be compared to FIG. 5, which shows a conventional journal pin 30 including grease port 20. Pin 30 comprises outer cylindrical surface 33. Grease port 20 comprises a generally planar surface or "flat" 22 formed in the pin 30 so as to form a recess. Lubricant passage 24 is in fluid communication with grease port 22 so supply grease from a lubricant reservoir (not shown). Flat 22 was conventionally placed during the manufacturing process to simplify the drilling of passage 24. The ends 23 of flat portion 22 creates an abrupt change in the curvature of the cylindrical surface 33. Ends 23 tend to act as wipers and interfere with the smooth transition of lubricant across port 20.

A conventional journal sleeve 12 is shown in FIG. 5 comprising end portions 15, each including a generally planar section 14 and including transition surfaces 16, 18. Transition surface 16 intersects outer sleeve surface 13 at a relatively sharp line of intersection 40. Likewise, on the inner sleeve surface, transition section 18 intersects with inner sleeve surface 17 at a relatively sharp line of intersection 41. In this arrangement, as journal sleeve 12 rotates relative to pin 30, intersection 41 provides a scraping surface or wiper, tending to scrape and remove the layer of lubricant that was desired to remain between surface 33 of pin 30 and inner surface 15 of journal sleeve 12.

Consequently, with the desired lubricant scraped by wiper surfaces at 41 and 21, the rotating surfaces, starved of adequate lubricant, could seize up and prevent rotation of the cone, causing the cone to drag rather than rotate, across the borehole bottom. This could potentially lead to bit failure or loss of acceptable ROP and require tripping the drill string prematurely, leading to time consuming and costly delays. By contrast, by providing an internal radius on the inner transition surface 194 of journal sleeve 132 as shown in FIGS. 3 and 4, the sleeve 132 does not present a sharp edge to act as a wiping surface and helps to maintain an evenly distributed, relatively thick lubricating film between the sliding surfaces of journal pin 118 and journal sleeve 132.

As previously discussed, providing and maintaining the proper amount and distribution of lubrication is essential to the sustained performance of the bearing. The lubricant, such as grease, is provided to the bearing through a lubricant passage 158. Referring back to FIG. 4, providing the smooth transition surface 176 that meets surface 133 at intersection 178 in a generally continuous contour, port 179 is structured so as to avoid providing a relatively sharp edge that can serve to wipe and remove desired lubricant from between surface 133 and journal sleeve 132 as sleeve 132 rotates relative to pin 118. Lubricant port 179 thus provides a gradual, rather than abrupt, rate of change to the volume of grease port 179 per rotational angle, so as to minimize the pressure variations and maintain the viscous lubricant between the rotating surfaces.

By contrast, with the sharp corners as present at intersections 21 such as in the prior art shown in FIG. 5, the relatively sharp corner 21 acts as a wiper that may strip lubricant from the critical rotating surfaces, or sufficiently disrupt the circulation of lubricant so as to lead to an early bit failure. Further, the milled flat 22 on the journal pin 30 creates a very abrupt change to the volume between the journal pin and the rotating sleeve 12. This abrupt change in volume causes rapid changes in pressure within the lubricant, a viscous fluid, as the lubricant moves from the tight space between pin 30 and sleeve 12 to the relatively open space between the sleeve and flat 22. These rapid pressure changes can cause undesirable pressure fluctuations in the lubricant, thereby degrading the performance of the bearing.

Figure 6A:
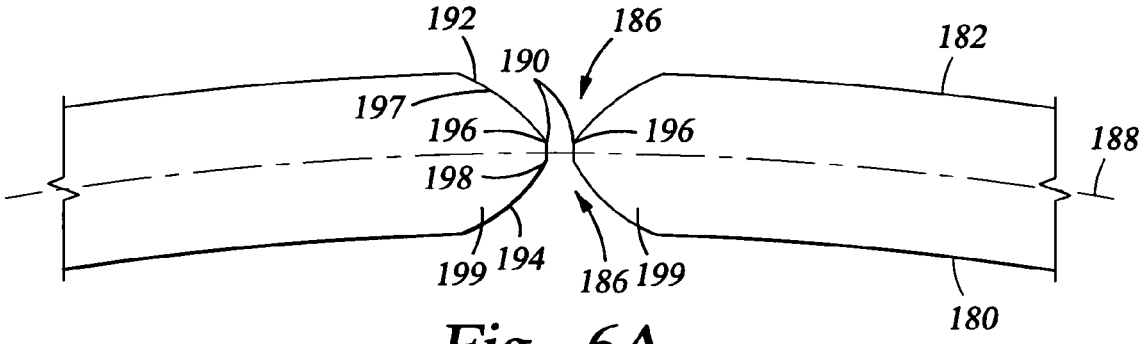
FIGS. 6A–6D are detailed, cross-sectional views showing alternate embodiments of the opposing ends of a journal sleeve.

Alternate embodiments of the continuously contoured ends 186 of journal sleeve 132 are shown in FIGS. 6A–6D Referring initially to FIG. 6A, centrally disposed between inner surface 180 and outer surface 182 is a central radius 188 that is concentric to surfaces 180, 182 and that intersects end portions 186 at midline 190. Each end 186 comprises outer transition surfaces 192 extending from midline 190 to outer sleeve surface 182, and an inner transition surface 194 extending from midline 190 to inner sleeve surface 180. As shown in FIG. 6A, in this embodiment, transition surfaces 192, 194 are each formed to have an internal radius between midline 190 and sleeve surfaces 182, 180. Likewise, in this embodiment, the radius of outer transition surface 192 is not constant, but comprises a smaller radius at segment 196 adjacent to midline 190, and a larger radius at segment 197 adjacent to outer sleeve surface 182. Similarly, inner transition surface 194 comprises inner segment 198 comprising a smaller radius than outer segment 199.

In this embodiment, segments 196 and 198 have substantially the same radius, and, likewise, the radii of segments 197, 199 are substantially the same; however, as explained by further examples herein, the radii of segments 196–199 may vary from those described with reference to FIG. 6A. As shown in the cross sectional view of FIG. 6A, inner transition surface 194 intersects inner sleeve surface 180 at transition point 199. It is desirable that the transition between surface 194 and 180 be as smooth as possible, and further that the change in slope along transition surface 194 change gradually, without abrupt or sharp changes between intersection 199 and midline 190.

Figure 6B:
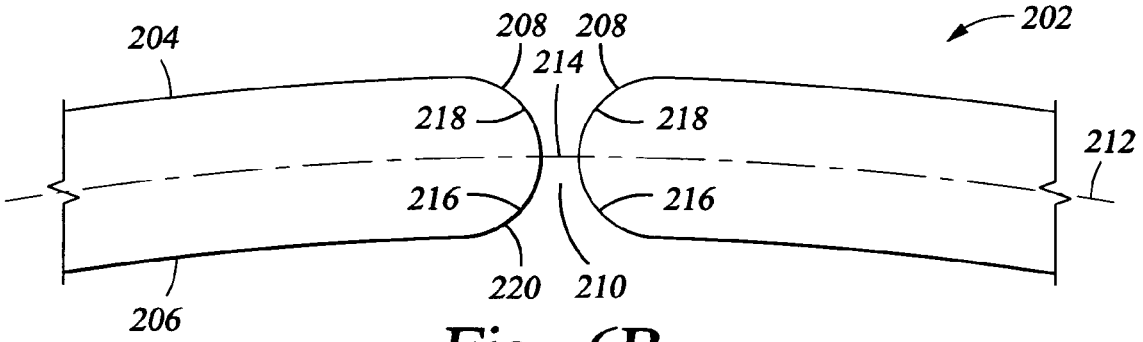

Referring now to FIG. 6B, an alternative embodiment comprising journal sleeve 202 is shown. Sleeve 202 comprises outer surface 204 and inner surface 206 and ends 208 adjacent to gap 210. Central radius 212 of sleeve 202 is concentric to surfaces 204, 206 and intersect ends 208 at midline 214. Ends 208 comprise inner and outer transition surfaces 216, 218 respectively. In this embodiment, transition surfaces 216, 218 are formed to have a substantially constant radius between midline 214 and their respective intersection with inner and outer surfaces 206, 204. Surfaces 216, 218 and most particularly, inner transition surface 216 is formed with an internal radius so as to avoid forming a sharp edge or line of intersection at 220.

Figure 6C:
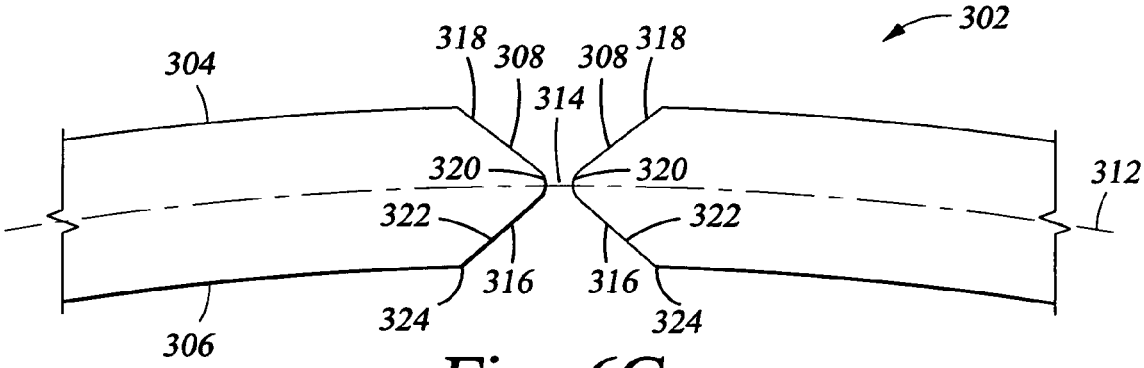

Additional embodiments are provided so as to provide smooth transitions and avoid wiping edges. For example, shown in FIG. 6C is journal sleeve 302 comprising outer and inner surfaces 304, 306 respectively, and in a central radius 312 intersecting ends 308 at midline 314. Journal sleeve 302 comprises inner and outer transition surfaces 316, 318 respectively. Surfaces 316, 318, each comprise an internal radius segment 320 adjacent to central radius 312, a generally flat intermediate portion 322, and a internal radius portion 324 that intersects with inner surface 306 in a smooth transition to avoid sharp corners and wiping surfaces.

Figure 6D:
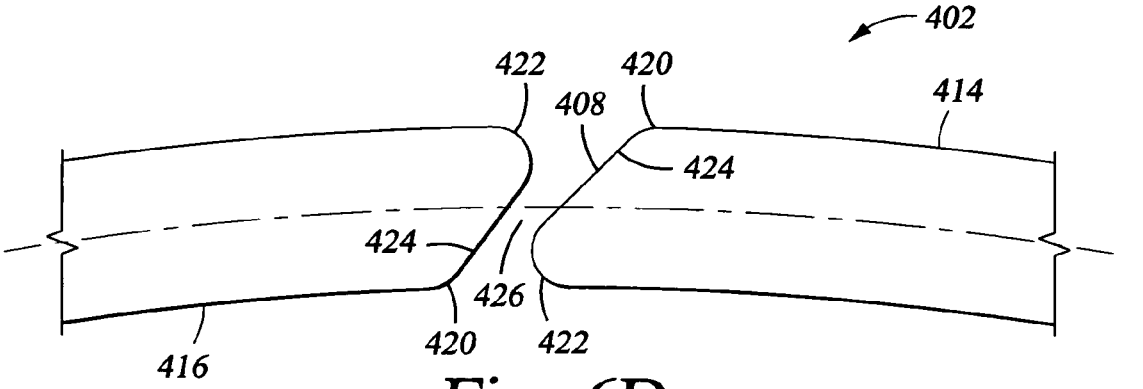

As shown in FIG. 6D an alternative sleeve 402 comprises ends 408 comprising an outer surface 414 and an inner surface 416. Each end 408 has a large radius transition 420 and a small radius transition 422 interconnected by a substantially flat surface 424, where the each large radius transition 420 is opposed across gap 426 by a small radius transition 422. This embodiments also does not have any sharp, wiper surfaces that will degrade the performance of the journal bearing.

While various embodiments of the invention have been shown and described, modifications thereof can be made by one skilled in the art without departing from the spirit and teachings of the invention. The embodiments herein are exemplary only, and are not limiting. Many variations and modifications of the apparatus and methods disclosed herein are possible and within the scope of the invention. Accordingly, the scope of protection is not limited by the description set out above, but is only limited by the claims which follow, that scope including all equivalents of the subject matter of the claims.

What is claimed is:

1. A drill bit comprising:

a journal pin having an outer surface;

a roller cone disposed about the outer surface of said journal pin;

a journal gap formed between the outer surface of said journal pin and said roller cone;

a lubrication port disposed in said journal pin and in fluid communication with said journal gap;

a supply of lubricant in fluid communication with said lubrication port;

a recess in the outer surface of said journal pin, wherein said recess is disposed about an outlet from said lubrication port into said journal gap and comprises a bottom surface; and one or more transition surfaces disposed between the bottom surface of said recess and the outer surface of said journal pin, wherein said transition surfaces provide a gradual slope between the bottom surface of said recess and the outer surface of said journal pin.

2. The drill bit of claim 1 further comprising a journal sleeve disposed in the journal gap.

3. The drill bit of claim 2 wherein said journal sleeve has continuously contoured opposing end portions forming a longitudinal gap.

4. The drill bit of claim 3 wherein the continuously contoured opposing end portions comprise an end surface having intersections with an inner surface and an outer surface of said journal sleeve.

5. The drill bit of claim 4 wherein the intersections are radiused.

6. The drill bit of claim 5 wherein the intersections have radiuses greater than 0.020 inches.

7. The drill bit of claim 1 wherein said transition surfaces are connected to the bottom surface by radiuses.

8. A lubrication system for a drill bit comprising a roller cone disposed on a journal pin, the lubrication system comprising:

a journal gap disposed between the roller cone and the journal pin;

a cylindiical journal sleeve disposed within the journal gap and comprising a longitudinal slot forming opposing end portions;

a lubrication port disposed within the journal pin and providing fluid communication between a lubrication supply and an outlet disposed in the journal gap; and a recess disposed on the journal pin surrounding the outlet from said lubrication port, wherein said recess comprises transitioning surfaces between a bottom surface of said recess and an outer surface of the journal pin, wherein the transitioning surfaces provide a gradual slope between the bottom surface of said recess and the outer surface of the journal pin.

9. The lubrication system of claim 8 wherein said journal sleeve further comprises:

a cylindrical body comprising an inner surface and an outer surface;

a gap through said cylindrical body, wherein said gap forms first and second opposing end portions; and a first continuously contoured surface formed on the first end portion and extending between the inner surface and the outer surface of said cylindrical body; and a second continuously contoured surface formed on the second end portion and extending between the inner surface and the outer surface of said cylindrical body.

10. The lubrication system of claim 9 wherein said first continuously contoured surface of said journal sleeve further comprises:

an inner transition surface extending from the inner surface of said cylindrical body to a midline between the inner surface and the outer surface; and an outer transition surface extending from the outer surface of said cylindrical body to the midline.

11. The lubrication system of claim 10 wherein said inner transition surfaces provide a smooth transition between the inner surface and the midline.

12. The lubrication system of claim 11 wherein said inner transition surface is curved.

13. The lubrication system of claim 12 wherein said inner transition surface has a single radius of curvature.

14. The lubrication system of claim 12 wherein said inner transition surface has more than one radius of curvature.

15. The lubrication system of claim 11 wherein said inner transition surface has the same shape as said outer transition surface.

16. The lubrication system of claim 10 wherein the second continuously contoured surface has the same shape as the first continuously contoured surface.

17. The lubrication system of claim 10 wherein the second continuously contoured surface is the minor image of the first continuously contoured surface.

18. A method for lubricating a drill bit comprising a roller cone rotating about a journal pin, the method comprising;

providing a journal gap disposed between the roller cone and the journal pin;

providing a journal sleeve disposed within the journal gap, wherein the journal sleeve has a longitudinal slot forming opposing ends;

shaping the opposing ends such that they are continuously contoured; and providing a lubricant from a lubricant supply into a lubrication port disposed in the journal pin.

19. The method of claim 18 further comprising providing an outlet in communication with the lubrication port and disposed within a recess on the outer surface of the journal pin.

20. The method of claim 19 further comprising providing transition surfaces between the recess and the outer surface of the journal pin.

* * * * *